US006510570B2

(12) United States Patent
Hartenstine et al.

(10) Patent No.: US 6,510,570 B2
(45) Date of Patent: Jan. 28, 2003

(54) PLAYARD HAVING CORNER PANELS

(75) Inventors: Curtis M. Hartenstine, Birdsboro, PA (US); Michael L. Longenecker, Ephrata, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 09/850,136

(22) Filed: May 8, 2001

(65) Prior Publication Data

US 2002/0166170 A1 Nov. 14, 2002

(51) Int. Cl.[7] ..... A47D 7/00; A47D 13/06
(52) U.S. Cl. ..... 5/99.1; 5/93.1; 5/98.1
(58) Field of Search ..... 5/99.1, 93.1, 98.1

(56) References Cited

U.S. PATENT DOCUMENTS

| | | | | | |
|---|---|---|---|---|---|
| 2,491,036 | A | * | 12/1949 | Dodge | 5/99.1 |
| 2,710,976 | A | * | 6/1955 | Martensen | 5/93.1 X |
| 2,908,021 | A | * | 10/1959 | Fulton | 5/99.1 |
| 2,974,325 | A | * | 3/1961 | Mango | 5/99.1 X |
| 3,165,760 | A | * | 1/1965 | Abajian | 5/97 |
| 4,070,716 | A | * | 1/1978 | Satt et al. | 5/99.1 |
| 4,202,065 | A | * | 5/1980 | Sullivan | 5/99.1 |
| 4,538,309 | A | * | 9/1985 | Gunter | 5/99.1 |
| 4,739,527 | A | | 4/1988 | Kohus et al. | 5/99.1 |
| 4,750,223 | A | * | 6/1988 | D'Arcy et al. | 5/99.1 |
| 4,811,437 | A | | 3/1989 | Dillner et al. | 5/99.1 |
| 4,837,875 | A | * | 6/1989 | Shamie et al. | 5/99.1 |
| D304,523 | S | * | 11/1989 | Dillner et al. | 5/99.1 X |
| 4,899,496 | A | * | 2/1990 | Chew, II | 5/98.1 |
| 4,900,011 | A | * | 2/1990 | Nolet | 5/98.1 X |
| 4,921,369 | A | * | 5/1990 | Chew, II et al. | 5/99.1 X |
| 4,985,948 | A | * | 1/1991 | Mariol | 5/99.1 |
| 5,163,191 | A | * | 11/1992 | Chan | 5/98.1 |
| 5,293,656 | A | * | 3/1994 | Chan | 5/98.1 X |
| 5,349,709 | A | * | 9/1994 | Cheng | 5/93.1 |
| 5,560,055 | A | * | 10/1996 | Ziegler | 5/99.1 |
| 5,586,345 | A | | 12/1996 | Nielson et al. | 5/99.1 |
| 5,697,111 | A | | 12/1997 | Dillner et al. | 5/99.1 |
| 5,727,265 | A | * | 3/1998 | Ziegler et al. | 5/99.1 |
| 5,813,064 | A | | 9/1998 | Hartenstine | 5/99.1 |
| 5,819,342 | A | | 10/1998 | Williams | 5/99.1 |
| 5,826,285 | A | * | 10/1998 | Mariol et al. | 5/99.1 |
| 5,862,548 | A | | 1/1999 | Gerhart | 5/93.1 |
| 5,867,851 | A | * | 2/1999 | Mariol et al. | 5/99.1 |
| 6,041,455 | A | * | 3/2000 | Raffo et al. | 5/99.1 |
| 6,058,528 | A | * | 5/2000 | Yang | 5/93.1 |
| 6,131,218 | A | * | 10/2000 | Wang | 5/93.1 |
| 6,182,308 | B1 | * | 2/2001 | Yang | 5/93.1 |
| 6,256,814 | B1 | * | 7/2001 | Drobinski | 5/99.1 |
| 6,279,181 | B1 | * | 8/2001 | Kessel | 5/99.1 |
| 6,357,462 | B1 | * | 3/2002 | Laosunthara et al. | 5/99.1 X |
| 6,421,850 | B1 | * | 7/2002 | Welsh, Jr. | 5/99.1 |

FOREIGN PATENT DOCUMENTS

| | | | | |
|---|---|---|---|---|
| FR | 2642288 A | * | 8/1990 | 5/99.1 |
| GB | 633677 | * | 12/1949 | 5/99.1 |
| GB | 2139505 A | * | 11/1984 | 5/99.1 |

* cited by examiner

*Primary Examiner*—Robert G. Santos
(74) *Attorney, Agent, or Firm*—Foley & Lardner

(57) ABSTRACT

A playard includes a leg, a flexible side panel, and a corner panel. The flexible side panel hugs against the leg so that the flexible side panel forms first and second side panel portions extending at an angle relative to each other about the leg to form a corner of the playard. The corner panel attaches to the inner sides of the angled first and second side panel portions. The corner panel is spaced from and covers the leg. In one embodiment, the corner panel comprises a flexible sheet stretched between the angled first and second side panel portions. In addition, the corner panel and portions of the first and side panel portions can form a corner pocket that hides the leg therein. The legs can be straight or bowed inwardly or bowed outwardly.

29 Claims, 9 Drawing Sheets

PLAYARD HAVING CORNER PANELS

BACKGROUND

This invention relates to a playard. More specifically, this invention relates to a playard having corner panels to isolate the legs of the playard from the interior space of the playard.

An exemplary playard is described in U.S. Pat. No. 4,811,437 to Dillner et al., which is incorporated by reference herein in its entirety. Playards provide an enclosed safe environment in which a child can be placed to sleep or to play. Although a conventional playard can come in many shapes, it generally is rectangular in shape and includes an upper support assembly, a lower support assembly, and four legs that extend between the support assemblies at each corner of the rectangle. The playard typically can be folded from an erect position to a folded position for transport and storage. The present invention provides additional features to improve the controlled environment of conventional playards.

SUMMARY OF THE INVENTION

The present invention relates to a playard. The playard can include a leg, a flexible side panel, and a corner panel. The flexible side panel hugs against the leg so that the flexible side panel forms first and second side panel portions extending at an angle relative to each other about the leg to form a corner of the playard. The corner panel attaches to the inner sides of the angled first and second side panel portions. The corner panel is spaced from and covers the leg. The corner panel can comprise a flexible sheet stretched between the angled first and second side panel portions. In addition, the corner panel and portions of the first and side panel portions can form a corner pocket that hides the leg therein.

According to the invention, the corner pocket can have a triangular cross-section. The portions of the side panel portions meet at a vertex of the triangular corner pocket, and the corner panel is positioned opposite the vertex and forms a side of the triangular corner pocket.

Further, a preferred embodiment of the playard includes three additional legs. The flexible side panel hugs all four legs to form a substantially rectangular area, with four corners, each of the three additional legs having an associated corner panel. In one embodiment, the legs of the playard can be bowed inwardly; in another embodiment, the legs of the playard can be bowed outwardly; and, in yet another embodiment, the legs can be straight.

The playard also can include a flexible bottom panel that connects to a lower end of the side panel. A floor board can be positioned above the bottom panel. In such an embodiment, each of the corner panels can terminate above the bottom panel with a gap therebetween to accommodate a respective corner of the floor board. The gap can be substantially equal to or greater than a thickness of the floor board at the respective corners.

In another aspect of the present invention, a four-sided playard having four legs and four upper support rails is provided. The four upper support rails connect upper portions of the four legs. The playard also has a lower support assembly connected to lower portions of the four legs, a bottom panel, and a side panel wrapped around the four legs to form four angled corners. The side panel is connected to the bottom panel. The playard further has four corner panels. Each corner panel is associated with and covers one of the four angled corners and hides the respective leg. Each corner panel is spaced from the respective leg to isolate the leg.

Another aspect of the invention relates to a method of isolating a leg of a playard positioned at a corner portion thereof. The method includes positioning a corner panel against inner sides of a flexible side panel adjacent a location where the side panel hugs the leg and forms first and second side panel portions extending at an angle relative to each other about the leg to form the corner. The method also includes securing the corner panel to the inner sides of the angled first and second side panel portions. According to the method, the corner panel is spaced from and covers the leg.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION

Figure 1:
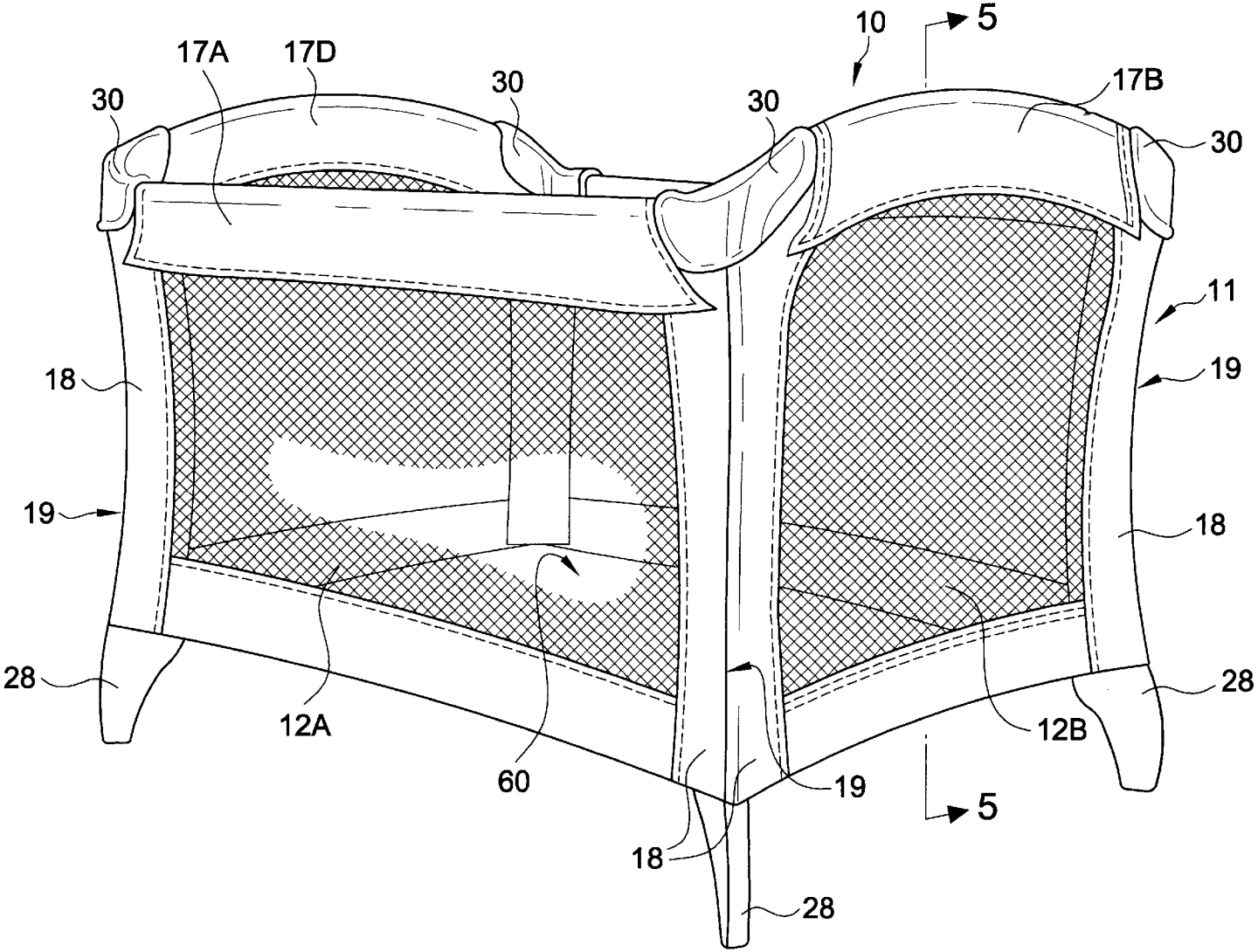
FIG. 1 is a perspective view of a playard having a corner panel in accordance with the invention.

FIG. 1 shows an embodiment of a foldable playard 10 according to the invention. The playard 1 includes a flexible side panel 11 that includes four side panel portions 12 (12A, 12B, 12C, 12D, collectively 12), each side panel portion 12 forming one of the sides of the four-sided playard. The side panel portions 12 can be joined together by vertically extending outer corner panels 18. The flexible side panel hugs the legs of the playard 1 at the outer panels 18 so that adjacent side panel portions 12 extend at an angle relative to each other to form a corner 19 of the playard 1. For a square or rectangular shaped playard, the corner angle can be about 90 degrees (i.e., a right angle).

The side panel portions 12 generally are attached together to form the flexible side panel 11. The side panel portions 12 can include mesh or netting to enhance ventilation and to allow the child to see and to be seen. Each of the side panel portions 12 also includes a laterally extending tubular sleeve 17 (17A, 17B, 17C, 17D) to facilitate mounting of the side panel 11 to respective upper support rail members of the playard frame, as will be described below.

Figure 4:
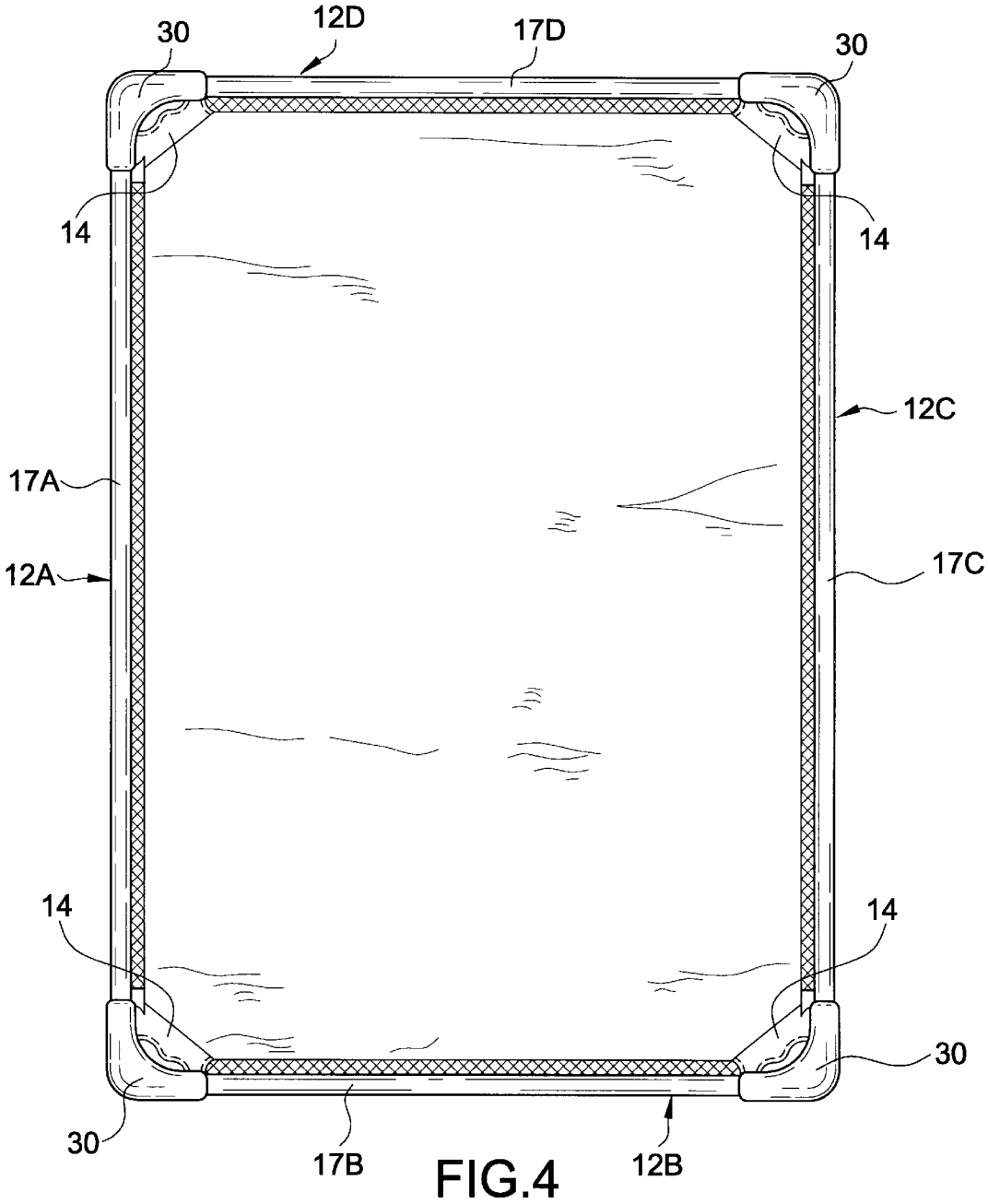
FIG. 4 is top plan view of the playard of FIG. 1.

The playard 1 also includes four inner corner panels 14, which are attached to the inner sides of adjacent side panel portions 12. For example, FIG. 4 shows a corner panel 14 attached to the inner sides of side panel portions 12C and 12D. A corner panel 14 is attached to the inner surfaces of adjacent side panel portions 12 at each corner area of the playard so that the corner panel 14 is spaced from and covers or hides the respective leg of the playard 1. The corner panel 14, which can be made of a flexible sheet material, is stretched so that it remains taut between the adjacent side panel portions 12. The corner panel 14 thus effectively isolates the leg from the interior space of the playard 1 so that a child playing in the playard cannot accidentally come into contact with the playard leg, which forms part of the rigid frame of the playard 1.

Figure 2:
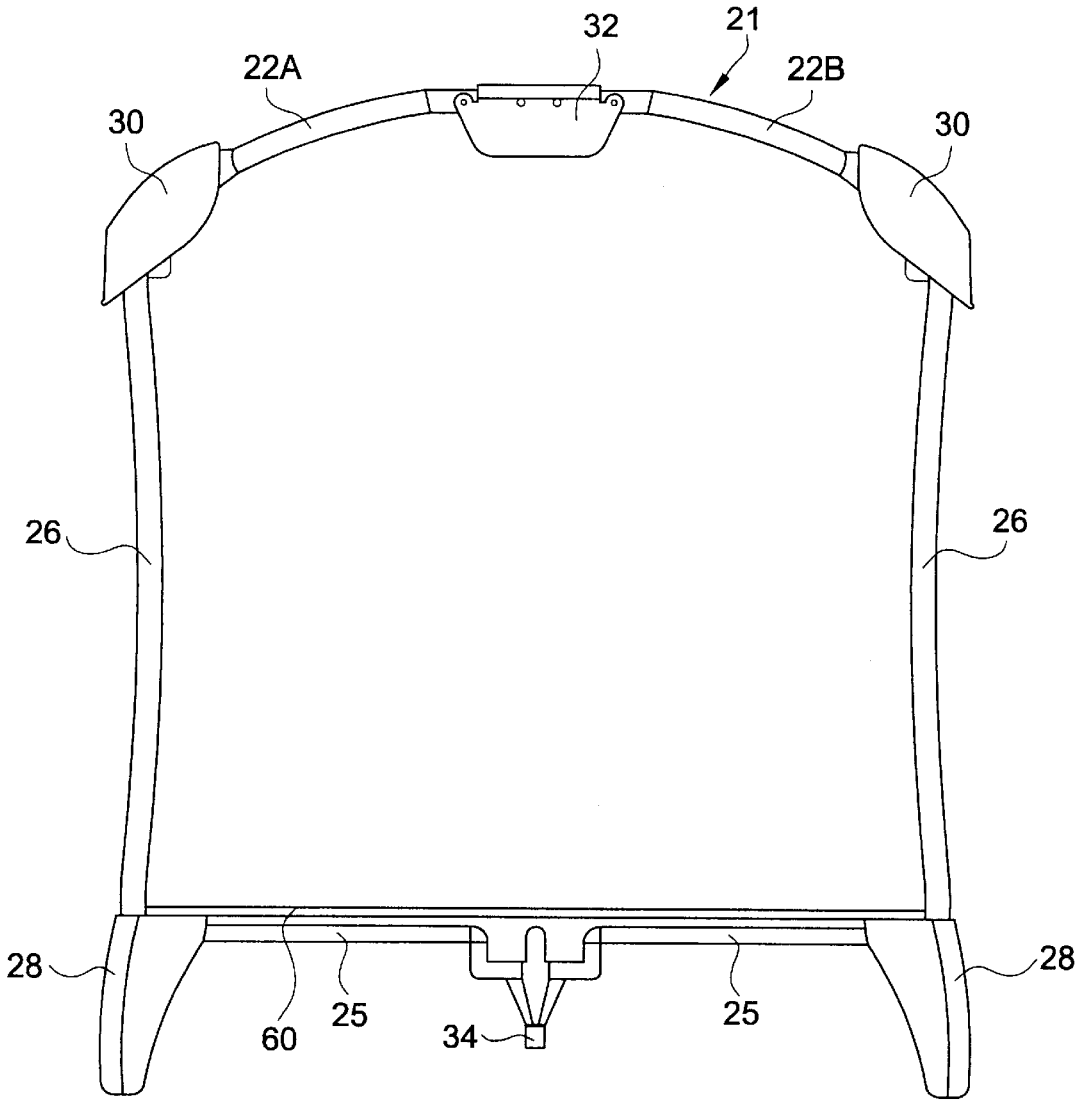
FIG. 2 is an end view of a playard frame with the flexible material removed.
Figure 3:
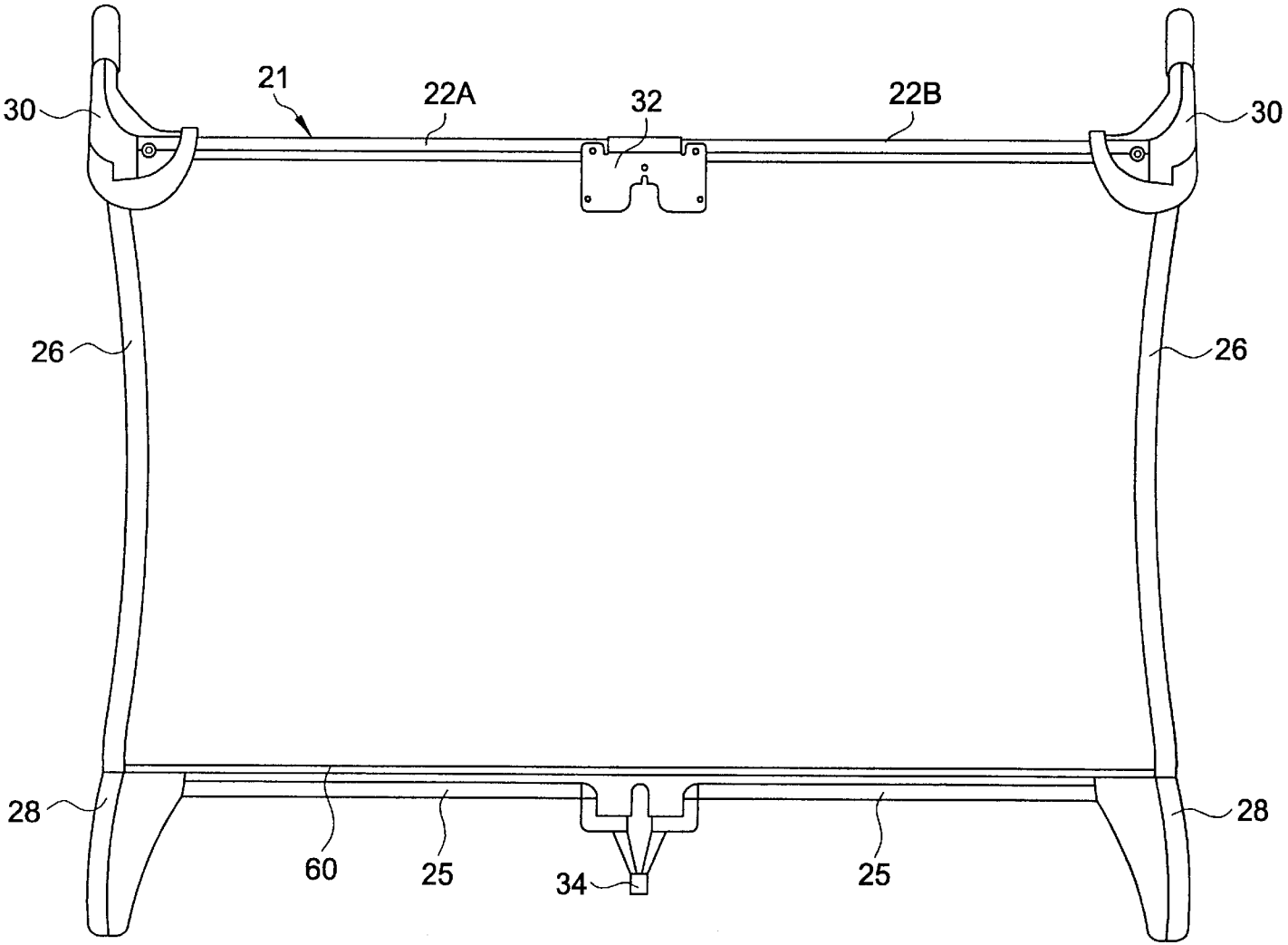
FIG. 3 is a side view of the playard frame of FIG. 2.

Turning to FIGS. 2 and 3, a frame structure 20 of the playard 1 will now be described. The frame includes an upper support assembly 21, a lower support assembly 24, and legs 26. The lower support assembly 24 can include rigid corner leg connectors 28 in the form of support feet. The upper portion of the playard frame includes rigid corner rail connectors or corner brackets 30. The feet 28 and corner brackets 30 can be molded from a polymeric plastic material such as ABS.

The upper support assembly 21 includes four upper support rail members. Each upper support rail member can include a pair of rigid, tubular metal rails 22A, 22B. The metal rails 22A, 22B can be linear, as shown in FIG. 3, to create a straight upper rail member, or they can be curved, as shown in FIG. 2, to create a curved upper rail member. The lengths of the rails 22A, 22B are determined by the width of the side of the playard on which the rails are located. End portions of the rails 22A, 22B are received in and pivotally connected to a respective corner bracket 30, for example, as described in U.S. Pat. No. 4,811,437. The opposite end portions of the rails 22A, 22B extend within and are pivotably coupled to a medial rail connecting member 32, for example, as shown and described in U.S. Pat. No. 4,811,437. The medial rail connecting members 32 are preferably made of a rigid metal material and facilitate pivoting of rails 22A, 22B. Each medial rail connecting member 32 houses a latch mechanism for automatically latching rails 22A, 22B in place when the playard is erect as shown in FIG. 1. One exemplary latch mechanism is shown and described in U.S. Pat. No. 4,811,437, but any known latch mechanism can be used.

The lower support assembly 24 of the playard frame includes a hub member 34 and a plurality of lower support members 25 extending between each foot 28 and the hub member 34, as best shown in FIGS. 2 and 3. Exemplary central hub members are shown and described in U.S. Pat. No. 4,811,437 to Dillner et al., U.S. Pat. No. 5,697,111 to Dillner et al., and U.S. Pat. No. 5,819,342 to Williams, all three incorporated herein by reference in its entirety. The lower support members 25 are pivotally coupled to the feet 28. The lower support assembly can also include hub legs (not shown) that extend out from the hub member 34 to further stabilize the playard.

The legs 26 of the playard frame interconnect the upper and lower support assemblies 21, 24 of the playard. In particular, an end portion of each leg 26 can be secured to an associated support foot 28, and the opposite end portion can be secured to an associated corner bracket 30. By actuating the hub member 34 and the medial rail connecting members 32, the playard can be collapsed from an in use position, as shown in FIG. 1, to a folded position for storage. A method of collapsing a playard is described in U.S. Pat. No. 4,811,437.

Referring now to FIGS. 1–4, it can be seen that side panel 11, which comprises side panel portions 12A, 12B, 12C, 12D, hugs or wraps around each leg 26 of the playard frame 20 so that adjacent side panel portions 12A, 12B, 12C, 12D extend at an angle relative to each other from the leg 26 to form the corners 19 of the playard 1. As mentioned above, corner panels 14 are attached to the inner sides of adjacent side panel portions 12A–12B, 12B–12C, 12C–12D, 12D–12A. The corner panel 14 can be stitched to the inner sides of the adjacent side panel portions.

Figure 6:
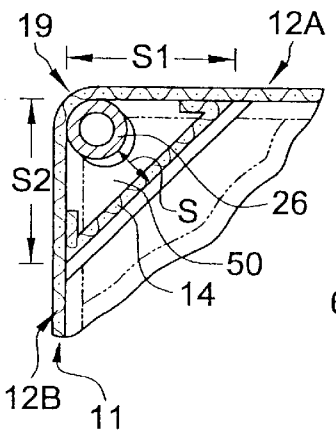
FIG. 6 is an enlarged top view in cross-section of a corner area of the playard, as taken along line 6—6 in FIG. 5.

FIG. 6, which is representative of each corner area of the playard 1, shows the relationship of side panel portions 12A, 12B, corner panel 14, and leg 26. This same relationship exists at each corner of the playard. The corner panel 14 and segments S1, S2 of the side panel portions 12A, 12B, respectively, form a corner pocket. The corner pocket 50 is generally triangular in cross-section. The portion of the side panel 11 hugging or wrapping the leg 26 forms a corner 19 of the playard, and this portion forms the vertex of the triangular corner pocket 50. The corner panel 14 defines a side (or the hypotenuse) of the triangular cross-section, which is opposite the vertex; segments S1, S2 define the remaining two sides of the triangular corner pocket. As evident from FIG. 6, if a child inadvertently bumps up against an inner corner of the playard, the child will contact the flexible corner panel 14 and not the rigid leg 26.

Each corner panel 14 is spaced by a spacing S away from the respective leg 26 of the playard frame. FIG. 6 shows spacing S measured from an outer surface of leg 26 to an outer surface of corner panel 14, where spacing S is normal to the outer surface of the leg 26. In one embodiment of the present invention, the spacing S can be equal to or greater than one half the inner diameter of the leg 26 to provide sufficient open buffer area between the corner panel 14 and the leg 26. In embodiments where the spacing S is less than one half the inner diameter of the leg 26, the corner panel 14 should be stretched sufficiently taut between side panel portions 12A, 12B (12C, 12D) so that the corner panel 14 does not flex toward the leg 26 when the child applies force to the corner panel 14.

FIGS. 1–6 show one embodiment of a playard in accordance with the invention, in which the legs 26 of the playard are bowed inwardly. The corner panels 14 can also bow inwardly, substantially in parallel with the legs 26. Because the legs 26 bow inwardly, the side panel portions 12A, 12B, 12C, 12D can be seen in the top view of the playard in FIG. 2, as they curve inwardly relative to the support rails 22 (shown in FIG. 2 covered by sleeves 17A, 17B, 17C, 17D).

Figure 7:
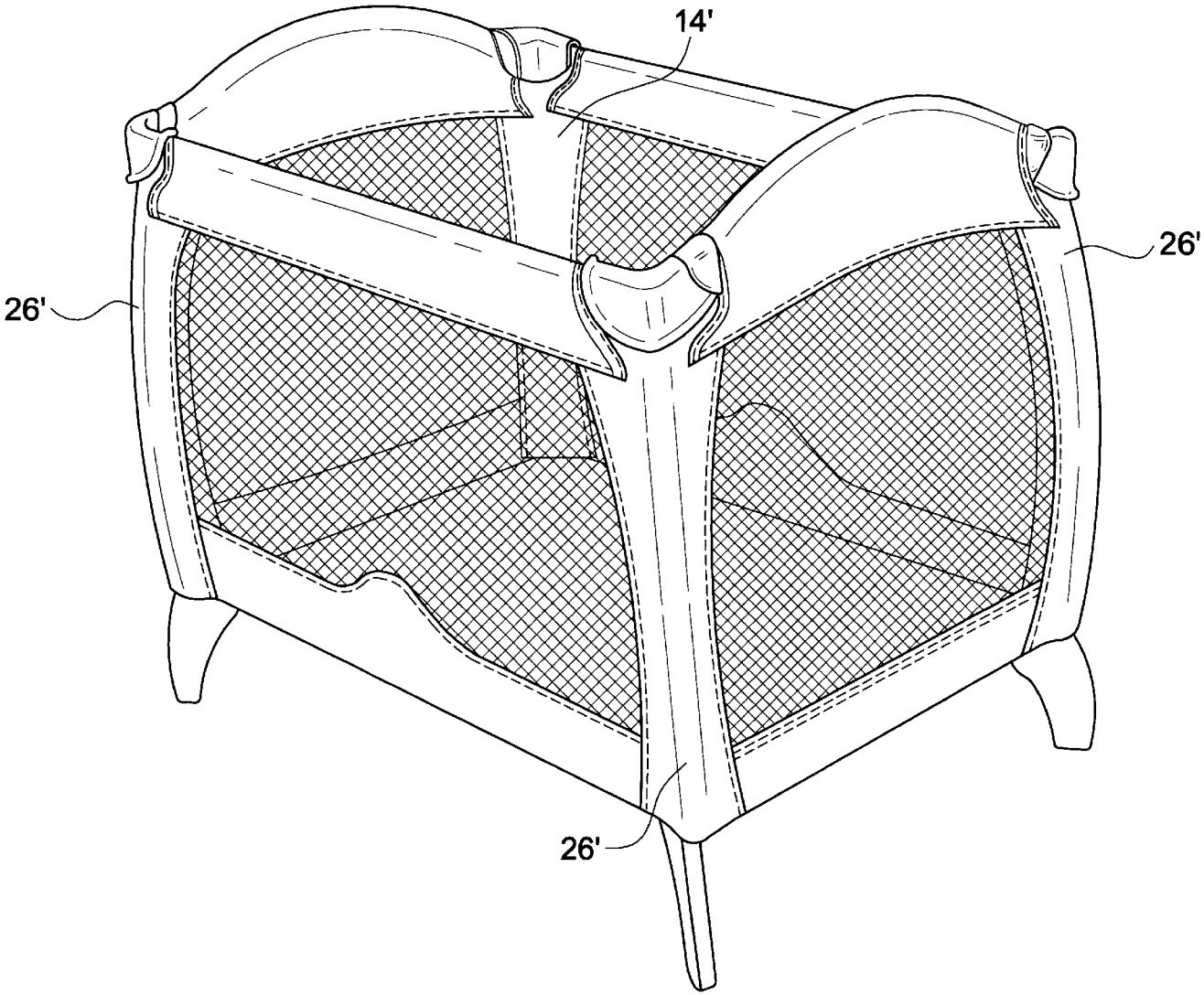
FIG. 7 is a perspective view of a playard having a corner panel in accordance with another embodiment of the invention.
Figure 10:
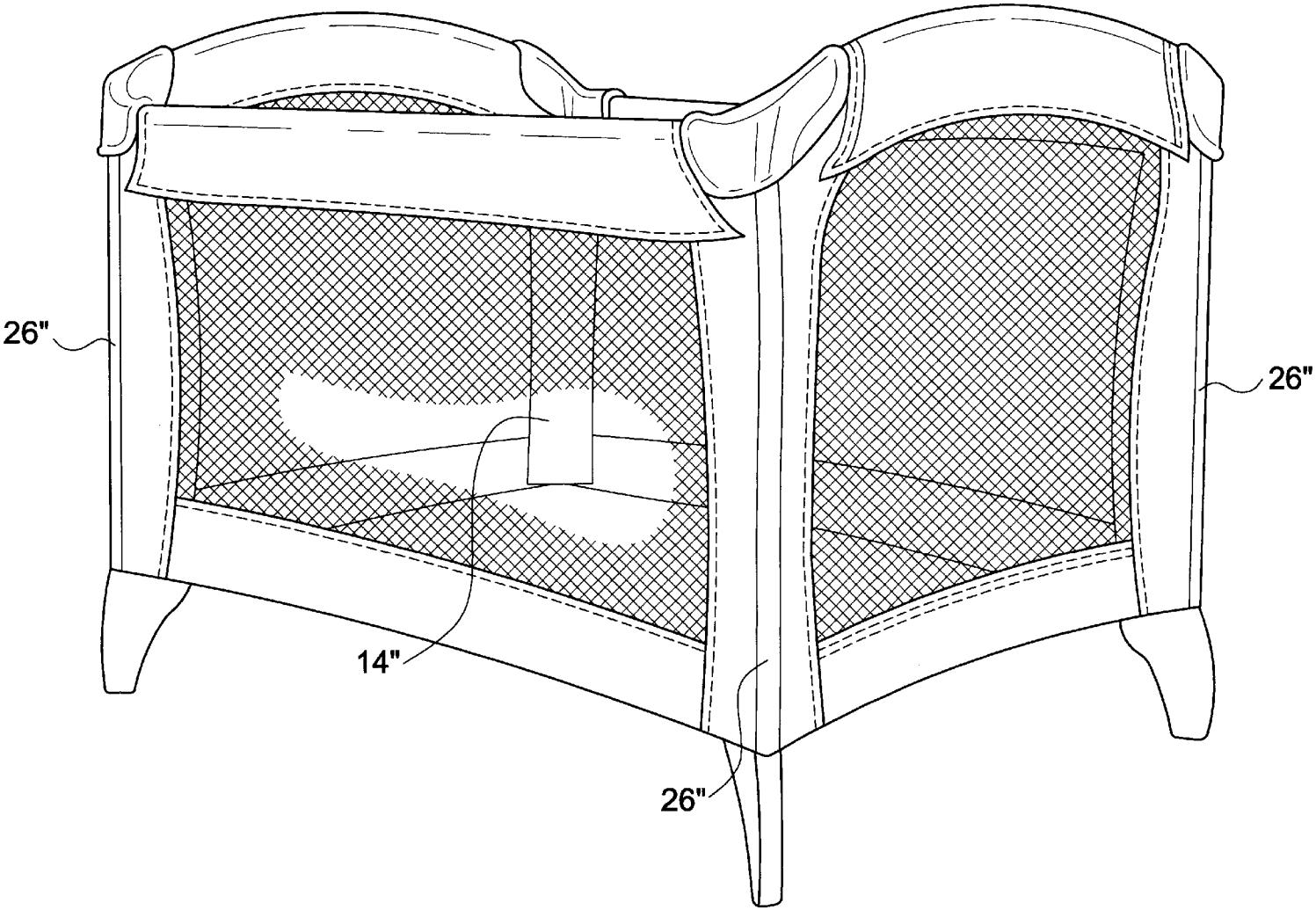
FIG. 10 is a perspective view of a playard having a corner panel in accordance with still another embodiment of the invention.

FIG. 7 shows another embodiment of the invention, in which the legs 26' bow outwardly. As in the embodiment of FIGS. 1–6, the corner panels 14' of this embodiment isolate the legs 26' from the interior space of the playard so that a child will not inadvertently come into contact with the rigid playard legs 26'. These corner panels 14' can also bow outwardly, substantially parallel with the playard legs 26'. It will be understood that the present invention also contemplates corner panels 14" for a playard having straight legs 26" to isolate the legs from the interior space of the playard, as shown in FIG. 10.

Figure 5:
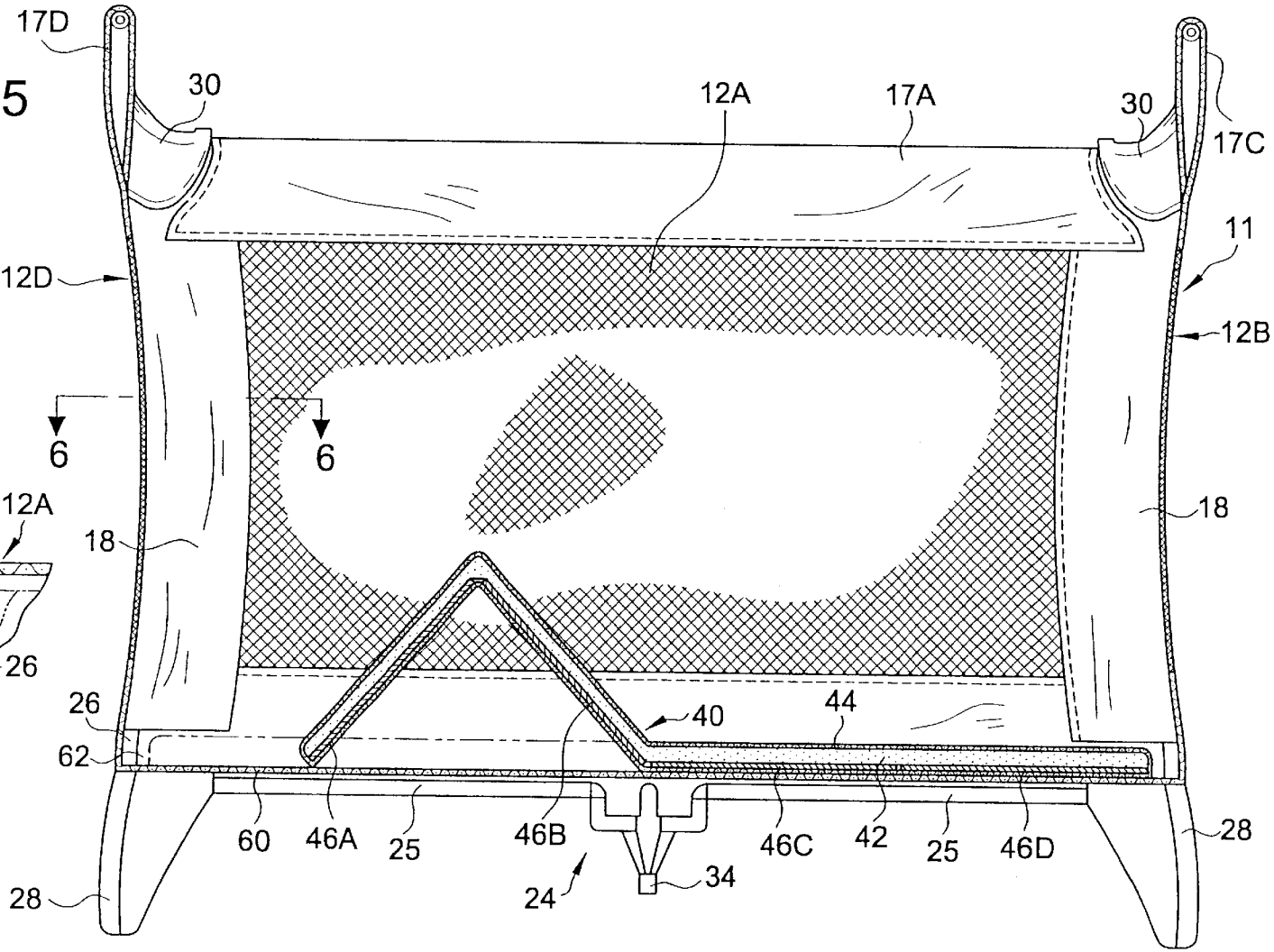
FIG. 5 is a side view in cross section of the playard, taken along line 5—5 in FIG. 1.

Referring again to FIGS. 1 and 5, the playard 1 of the present invention also includes flexible bottom panel 60 that is attached to the lower edge of the side panels 12. The flexible bottom panel 60 can be sewn to the side panels 12. The playard also can include a floor board 40 that can be positioned above and rest on the bottom panel 60, as shown in FIG. 5. When the floor board 40 is in place, the lower support members 25 and the hub member 26, along with the bottom panel 60, support the floor board 40. The floor board 40 can comprise a foam cushion 42 enclosed in a layer or layers of fabric material, such as nylon, that form a pad cover 44. The floor board 40 typically is partitioned into four sections, each containing one of four rigid stiffening platforms 46 (46A, 46B, 46C, 46D). Each platform 46 can be made from a Masonite material, for example. To position the floor board 40 in place on the bottom panel 60, the floor board 40 can be bent at the joints between the stiffening platforms 46 and then unfolded into place in the playard. FIG. 5 shows stiffening platforms 46A and 46B in a bent position prior to being unfolded onto the bottom panel 60; FIG. 5 shows stiffening platforms 46C and 46D unfolded to rest on the bottom panel 60. The floor board 40 can serve the dual purpose of providing a smooth playing surface for the child when inserted in the playard 1, as shown in FIG. 2, for example, or the floor board 40 can be removed from the playard 1 and folded into a carrying case for the playard 1, as described in U.S. Pat. No. 4,811,437.

The construction of the playard 1 of the present invention keeps the floor board 40 secure in place while a child is in the playard. In this regard, as shown in FIG. 5, each corner panel 14 can terminate above the bottom panel 60 to leave a gap 62 between the bottom of the corner panel 14 and the bottom panel 60. The gap 62 can be dimensioned to accommodate a respective corner of the floor board 40. In one embodiment, the gap 62 can be substantially equal to the thickness of the floor board 40. When the corner of the floor board 40 is placed underneath the lower end of the respective corner panel 14, the corner panel 14 can serve to keep any coverings on the floor board 40, such as sheets, tight against the floor board 40 and tightly tucked into the corner of the playard 1. The gap 62 also can sized slightly smaller than the floor board thickness so that, when the floor board 40 is positioned underneath the corner panel 14, the lower end of the corner panel 14 pushes downward on the flexible cushion 42 of floor board 40 to hold the floor board 40 and floor board coverings even more tightly in place.

Figure 8:
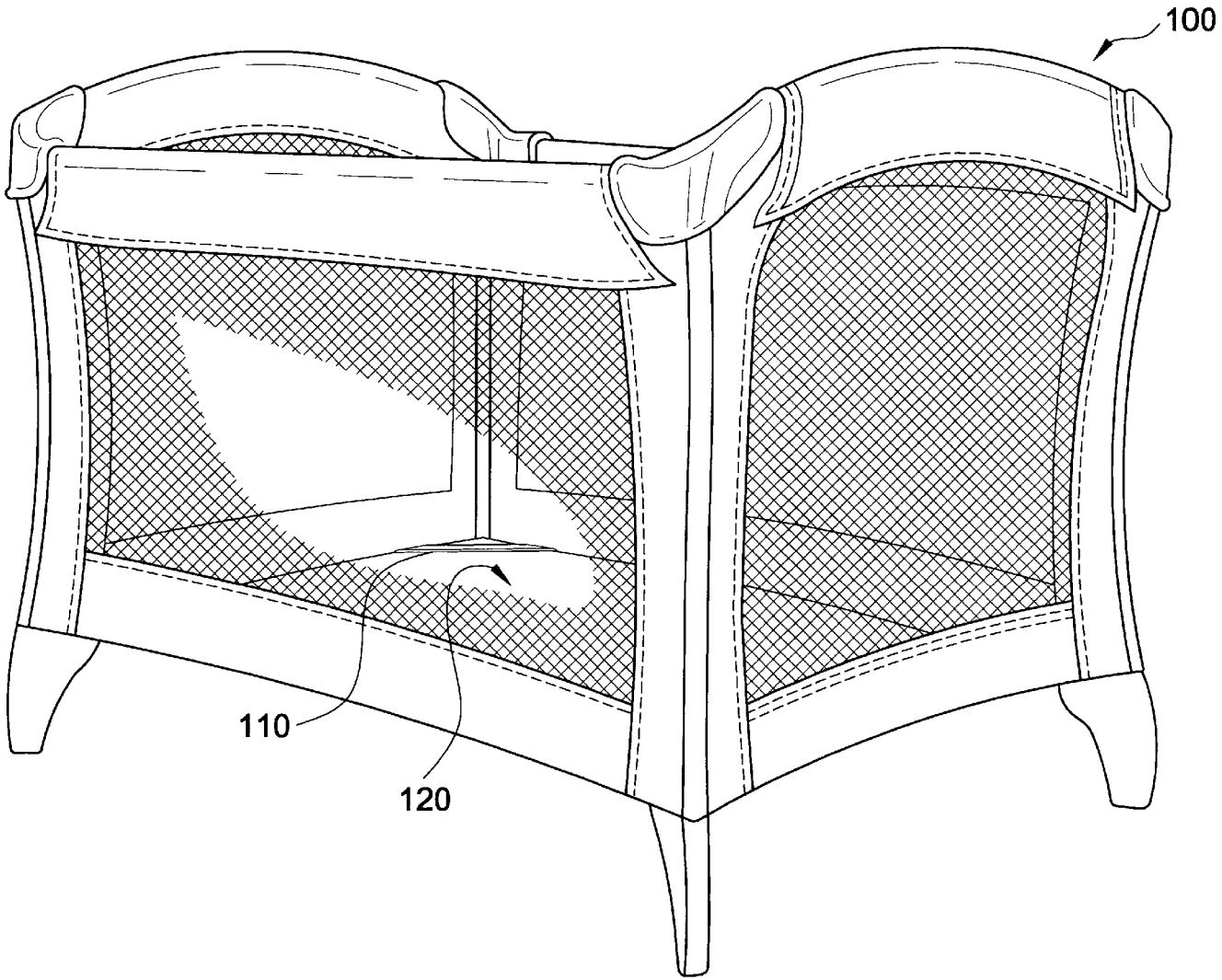
FIG. 8 is a perspective view of a playard having a corner strap in accordance with yet another embodiment of the invention.
Figure 9:
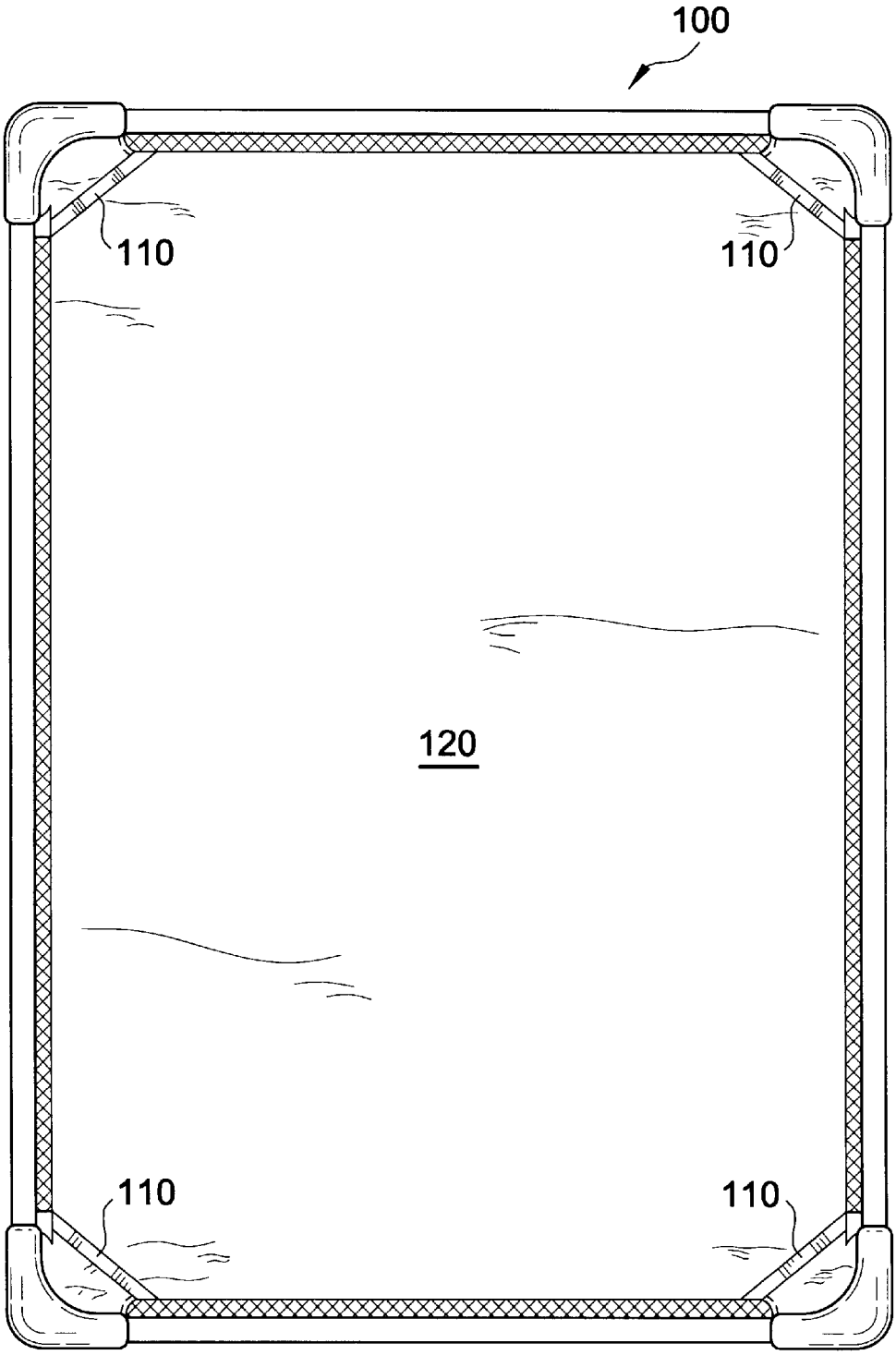
FIG. 9 is a top plan view of the playard in FIG. 8.

FIGS. 8 and 9 show another playard 100, which does not include the corner panels of the embodiment shown in FIGS. 1–7. The playard 100 includes straps 110 fixed to each corner of the bottom panel 120 to secure a floor board (not shown) in place. The corners of the floor board can be slipped under the straps 110. The straps 110 ensure that any coverings on the floor board, such as sheets, stay tight against the floor board. The straps 110 can be made of a fabric or plastic material or both, and the straps 110 can be elastic to allow a parent to pull the straps 110 upward toward the top of the playard to provide enough clearance between the strap 110 and the bottom panel 120 for the floor board to be slipped underneath the straps and secured in place. The ends of the straps 110 can be sewn to the bottom panel 120 or sewn to the lower edges of adjacent side panel portions to attach the straps 110 to the playard 100. In addition, although FIGS. 8 and 9 show the straps 100 in a playard with inwardly bowed legs, the straps 110 can be used with any conventional playard.

Another aspect of the invention relates to a method of isolating a leg of a playard positioned at a corner portion thereof. The method includes positioning a corner panel against inner sides of a flexible side panel adjacent a location where the side panel hugs the leg and forms first and second side panel portions extending at an angle relative to each other about the leg to form the corner. The method also includes securing the corner panel to the inner sides of the angled first and second side panel portions. According to the method, the corner panel is spaced from and covers the leg.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. A playard comprising:

a leg;

a flexible side panel hugging against the leg so that the flexible side panel forms first and second side panel portions extending at an angle relative to each other about the leg and forming a corner;

a corner panel attached to inner sides of the angled first and second side panel portions;

a flexible bottom panel that connects to a lower end of the side panel, and a cushioned floor board positioned above the bottom panel, wherein the corner panel is spaced from and covers the leg, and the corner panel terminates above the bottom panel with a gap therebetween to accommodate a corner of the floor board.

2. A playard according to claim 1, wherein the corner panel comprises a flexible sheet stretched between the angled first and second side panel portions.

3. A playard according to claim 2, wherein the corner panel is stitched to the angled first and second side portions.

4. A playard according to claim 2, wherein the corner panel and portions of the first and side panel portions form a corner pocket that hides the leg therein.

5. A playard according to claim 4, wherein the corner pocket has a triangular cross-section, wherein the portions of the side panel portions meet at a vertex of the triangular corner pocket, and the corner panel is positioned opposite the vertex and forms a side of the triangular corner pocket.

6. A playard according to claim 5, further including three additional legs, the flexible side panel hugging against all four legs to form a substantially rectangular area, with four corners, each of the three additional legs having an associated corner panel.

7. A playard according to claim 6, wherein each of the four legs is bowed inwardly.

8. A playard according to claim 6, wherein each of the four legs is bowed outwardly.

9. A playard according to claim 7, wherein each of the four corner panels is bowed inwardly, substantially parallel with the bowed leg.

10. A playard according to claim 8, wherein each of the four corner panels is bowed outwardly, substantially parallel with the bowed leg.

11. A playard according to claim 1, wherein the floor board includes at least one stiffening platform, a cushion, and a floor board cover.

12. A playard according to claim 1, wherein the gap is substantially equal to or greater than a thickness of the floor board at the corner.

13. A playard according to claim 1, further including a lower support assembly connecting the four legs.

14. A playard according to claim 1, wherein the gap is smaller than a thickness of the floor board at the respective corners.

15. A playard comprising:

four legs;

a flexible side panel hugging against the legs to form a substantially rectangular area with four corners, the flexible side panel forming a pair of side panel portions extending at an angle relative to each other about each of the legs to form the respective four corners; and corner panels attached to the inner sides of each pair of angled side panel portions, wherein the corner panels are spaced from and cover the respective legs, wherein the corner panels and portions of the respective pair of angled side panel portions form corner pockets that hide the respective legs therein, wherein the corner pockets have triangular cross-sections, the portions of the respective pairs of angled side panel portions meet at a vertex of the respective triangular corner pockets, and the corner panels are positioned opposite the vertex and form a side of the respective triangular corner pockets, and wherein each of the four legs is straight.

16. A multi-sided playard having legs and upper support rails connecting upper portions of the legs and a lower support assembly connected to lower portions of the legs, a bottom panel, and a side panel looped around the legs to form angled corners, the side panel being connected to the bottom panel, comprising:

corner panels each covering the respective corner and hiding the respective leg, wherein each of the corner panels is spaced from the respective leg to isolate the same; and a cushioned floor board positioned above the bottom panel, each of the corner panels terminating above the bottom panel with a gap therebetween to accommodate a respective corner of the floor board.

17. A playard according to claim 16, wherein each of the corner panels comprises a flexible sheet stretched across the side panel at the respective corner.

18. A playard according to claim 17, wherein each of the corner panels is stitched to the side panel.

19. A playard according to claim 16, wherein the corner panels each form a corner pocket with the side panel to hide the respective leg therein.

20. A playard according to claim 19, wherein the playard has a triangular cross-section, wherein portions of the side panel meet at the vertex of the triangular corner pocket, and the corner panel is positioned opposite the vertex and form a side of the triangular corner pocket.

21. A playard according to claim 16, wherein the floor board comprises at least one stiffening platform, a cushion, and a floor board cover.

22. A playard according to claim 16, wherein the gap is substantially equal to or greater than a thickness of the floor board at the respective corners.

23. A playard comprising:

an upper support assembly;

a lower support assembly;

legs extending between the upper and lower support assemblies;

a side panel that wraps around the legs to form side panel portions of the playard;

corner panels each attached to the inner sides of adjacent side panel portions opposite a respective leg and each covering and spaced from the respective leg;

a bottom panel connected to a lower end of the side panel; and a cushioned floor board positioned above the bottom panel, wherein each of the corner panels terminates above the bottom panel with a gap therebetween to accommodate a respective corner of the floor board.

24. A method of securing a floor board of a playard in place, comprising:

providing a playard with legs, a side panel hugging the legs, a bottom panel that connects to the side panel, and a cushioned floor board positioned above the bottom panel;

positioning corner panels against inner side portions of the side panel opposite each of the legs, each of the corner panels terminating above the bottom panel to maintain a gap therebetween; and placing the floor board above the bottom panel and positioning corners of the floor board in the gap underneath each corner panel.

25. A playard comprising:

an upper support assembly;

a lower support assembly;

legs extending between the upper and lower support assemblies;

a bottom panel having a strap fixed to each corner of the bottom panel configured to secure a floor board to the bottom panel.

26. A playard according to claim 25, wherein the straps are dimensioned to accommodate respective corners of the floor board.

27. A playard according to claim 25, wherein the straps are elastic.

28. A playard comprising:

an upper support assembly;

a lower support assembly;

legs extending between the upper and lower support assemblies;

a side panel that wraps around the legs to form side panel portions of the playard;

a bottom panel; and a plurality of straps affixed to lower edges of adjacent side panel portions and located relative to the bottom panel configured to secure a floor board to the bottom panel.

29. A playard according to claim 28, wherein the straps are located to accommodate respective corners of the floor board.

* * * * *